US005144872A

United States Patent [19]

Kakimoto

[11] Patent Number: 5,144,872

[45] Date of Patent: Sep. 8, 1992

[54] MULTIPLE PUNCHING PRESS

[75] Inventor: Masakazu Kakimoto, Aichi, Japan

[73] Assignee: Ushio Co., Ltd., Aichi, Japan

[21] Appl. No.: 735,770

[22] Filed: Jul. 29, 1991

Related U.S. Application Data

[63] Continuation of Ser. No. 426,432, Oct. 25, 1989, abandoned.

[30] Foreign Application Priority Data

Oct. 28, 1988 [JP] Japan ..... 63-274114

[51] Int. Cl.[5] ..... B26F 1/04

[52] U.S. Cl. ..... 83/13; 83/571; 234/114

[58] Field of Search ..... 234/111, 114, 115, 116; 83/571, 563, 588, 13

[56] References Cited

U.S. PATENT DOCUMENTS

| | | | |
|---|---|---|---|
| 3,022,000 | 2/1962 | Millis | 234/114 |
| 3,311,297 | 3/1989 | Williamson et al. | 234/116 |
| 3,518,756 | 7/1970 | Bennett et al. . | |
| 3,738,569 | 6/1973 | Killaly, Sr. | 234/43 |
| 4,094,944 | 6/1978 | Paetz . | |
| 4,532,843 | 8/1985 | Miyama . | |
| 4,539,058 | 9/1985 | Burgess et al. . | |
| 4,555,966 | 12/1985 | Klingel | 83/71 |
| 4,621,407 | 11/1986 | Suzuki . | |
| 4,623,089 | 11/1986 | Scott | 234/114 |
| 4,653,365 | 3/1987 | Takasaki et al. . | |
| 4,685,613 | 8/1987 | Schambre | 234/115 |

FOREIGN PATENT DOCUMENTS 63-267195 11/1988 Japan .

*Primary Examiner*—Mark Rosenbaum
*Assistant Examiner*—John M. Husar
*Attorney, Agent, or Firm*—Sandler, Greenblum & Bernstein

[57] ABSTRACT

A multiple punching press includes a supporting framework having a die block with a plurality of slug holes. A movable punch holder moves relative to the die block and includes a plurality of punch pins that are movable within the movable punch holder between a first limit position where the punch pin is able to pierce the workpiece and a second limit position where the punch pin is unable to pierce the workpiece. Each punch pin includes a position setting mechanism that includes an actuator and cam to move the punch pins against the biasing force of a spring.

25 Claims, 4 Drawing Sheets

MULTIPLE PUNCHING PRESS

This application is a continuation of application Ser. No. 07/426,432, filed Oct. 25, 1989, now abandoned.

BACKGROUND OF THE INVENTION

1. Field of the Invention

The present invention relates to a multiple punching press, and more particularly to a punching press that simultaneously pierces and forms perforations in a workpiece, such as a substrate or other sheet-like material.

2. Description of Background and Relevant Information

In conventional multiple punching presses, punch pins are arranged according to a predetermined perforation pattern for a workpiece to be processed. However, if a workpiece includes a portion that does not correspond with the arrangement of punch pins due, for example, to the feeding of the workpiece, the punch press is unable to punch that particular portion, and another arrangement of punch pins must be prepared The workpiece must then go through another punching operation to finally complete the punching of the workpiece. This slows the punching process and reduces productivity, especially if the workpiece is a substrate that is to be continuously perforated with a large number of pin holes.

SUMMARY OF THE INVENTION

An object of the present invention is to solve the problems of the conventional punching presses described above by providing a punch press where the pattern of the plurality of punch pins is arranged so as to be changeable as the punching process continuously proceeds, whereby the productivity of the punching operation is improved.

The multiple punching press for piercing a workpiece of the present invention includes a supporting framework, a die block mounted on the supporting framework which includes a plurality of slug holes, a movable punch holder mounted on the supporting framework for movement relative to said die block, a plurality of punch pins held within the movable punch holder in either a first or second limit position, each punch pin being aligned with a respective slug hole, and at least one position setting mechanism mounted on the supporting framework for controlling the position of at least one punch pin between its first or second limit position, whereby the at least one punch pin is able to pierce the workpiece when in its first limit position and unable to pierce the workpiece when in its second limit position.

The multiple punching press according to the invention, further includes a plurality of fixing holes in said movable punch holder, each of the plurality of punch pins being held in a respective fixing hole. A fixed punch holder is mounted on the supporting framework and includes a plurality of guide holes, each guide hole being aligned with a respective fixing hole.

According to another aspect of the invention, biasing means bias at least one punch pin towards its second limit position. The biasing means may be a coil spring. The position setting mechanism moves said at least one punch pin to its first limit position.

Each punch pin includes a punch nose for piercing the workpiece and an upper portion projects from the fixing hole. The position setting mechanism engages the upper portion to move the punch pin to its first limit position. A cam is connected to an actuator and engages the upper portion of the punch pin. The actuator may be a fluid cylinder or a solenoid.

Accordingly to another aspect of the invention, the movable punch holder includes a space, the upper portion of each punch pin projecting into the space, and the cam engaging the upper portion within the space. The actuator and the punch pin are arranged substantially perpendicular to each other.

The multiple punching press according to the invention further includes means to absorb shock between the movable punch holder and the fixed punch holder The means to absorb shock may be at least one spring.

According to another aspect of the invention, the multiple punching press includes a plurality of position setting mechanisms for selectively controlling the position of a plurality of respective punch pins. Each position setting mechanism includes an actuator which is selectively controlled by a computer.

The movable punch holder and the die block may be constructed as a unit. Each unit includes only one punch pin and only one slug hole and a plurality of the units are assembled onto the supporting framework.

The invention also includes a method of piercing a workpiece comprising:

a) providing a movable punch holder with a plurality of punch pins;

b) selectively moving at least one punch pin between a first limit position and a second limit position within the movable punch holder; and c) moving the movable punch holder to pierce the workpiece, whereby at least one punch pin is able to pierce the workpiece when in the first limit position and is unable to pierce the workpiece when in the second limit position.

The method also includes selectively moving a plurality of punch pins between the first limit position and the second limit position, and engaging at least one punch pin with a cam to move the punch pin to the first limit position. The punch pin is biased to the second limit position.

The method of piercing a workpiece according to the invention also includes forming the movable punch holder and a die block as a unit, and assembling a plurality of the units to form, an assembly of a plurality of punch pins.

The method of piercing a workpiece further includes absorbing shock caused by movement of the movable punch holder.

BRIEF DESCRIPTION OF THE DRAWINGS

The invention is further explained in the description which follows with reference to the drawings illustrating, by way of non-limiting examples, embodiments of the invention wherein.

DESCRIPTION OF THE PREFERRED EMBODIMENTS

Figure 1:
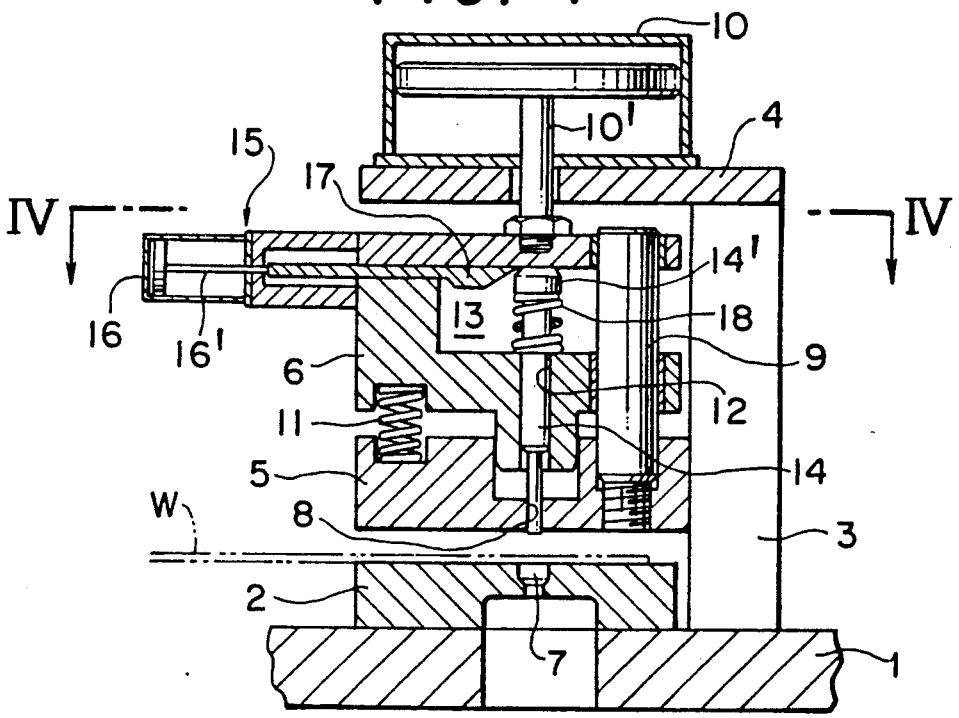
FIG. 1 is a sectional view where the punch pin is at the upper limit position.

The multiple punching press of the present invention includes a movable punch holder provided above a die block which has a plurality of slug holes. The movable punch holder is arranged to vertically reciprocate. A plurality of punch pins are provided to be aligned and held within the movable punch holder and are arranged to be movable up and down. A position setting mechanism is provided to control the position of each nose of the punch pins between the lower limit position to enable piercing a workpiece and the upper limit position so as to be disabled from piercing the workpiece.

Referring to the drawings, the multiple punching press of the present invention includes die holder 1, die block 2 which is mounted on die holder 1, crown frame 4 which is supported by supporting framework 3, 3 which are mounted on die holder 1.

Fixed punch holder 5 is fixed to supporting framework 3, 3 with a suitable clearance between the bottom of fixed punch holder 5 and the upper surface of die holder 1. Movable punch holder 6 is arranged in the space above fixed punch holder 5.

Die block 2 includes a plurality of slug holes 7 along its width with a predetermined space between each slug hole. Fixed punch holder 5 is the same width as die block 2 and includes a plurality of punch guide holes 8 along its width, corresponding to the respective slug holes 7.

A plurality of upright guide pins 9 pass through fixed punch holder 5 at its rear side and movable punch holder 6 is slidably arranged with respect to guide pins 9 to vertically move relative to fixed punch holder 5.

Movable punch holder 6 is substantially the same size in width as die block 2. One or more piston rods 10' of one or more air cylinders 10 are connected to the upper surface of movable punch holder 6 so as to elevate or lower the movable punch holder 6 upon actuation of air cylinder 10. A plurality of a coil springs 11 are disposed between the bottom of movable punch holder 6 and fixed punch holder 5 so as to absorb any shock.

Punch fixing holes 12 are vertically bored through the core of movable punch holder 6 with a predetermined spacing between the holes in the width direction so as to be aligned with slug holes 7 in die block 2. Space portion 13 is provided at the upper end of punch fixing holes 12.

A plurality of punch pins 14 are slidably inserted in punch fixing holes 12 of movable punch holder 6 and a coil spring 18 is disposed between punch head 14' of each punch pin 14 and the upper surface of punch fixing hole 12 so as to upwardly bias punch pin 14. The upper portion of punch o pin 14 projects into space portion 13 and punch head 14' is provided at the top portion of punch pin 14.

A plurality of position setting mechanisms 15 are provided for, each punch pin 14 at the front upper portion of movable punch holder 6. Each position setting mechanism 15 includes air cylinder 16 having rod 16' and cam 17 connected to rod 16'. Cam 17 is disposed adjacent punch head 14' of punch pin 14 in space portion 13.

Cam 17 is positioned at a front portion of punch head 14' when rod 16, of air cylinder 16 is retracted, and cam 17 engages the punch head 14' and pushes it down when rod 16' of air cylinder 16 is extended.

Figure 2:
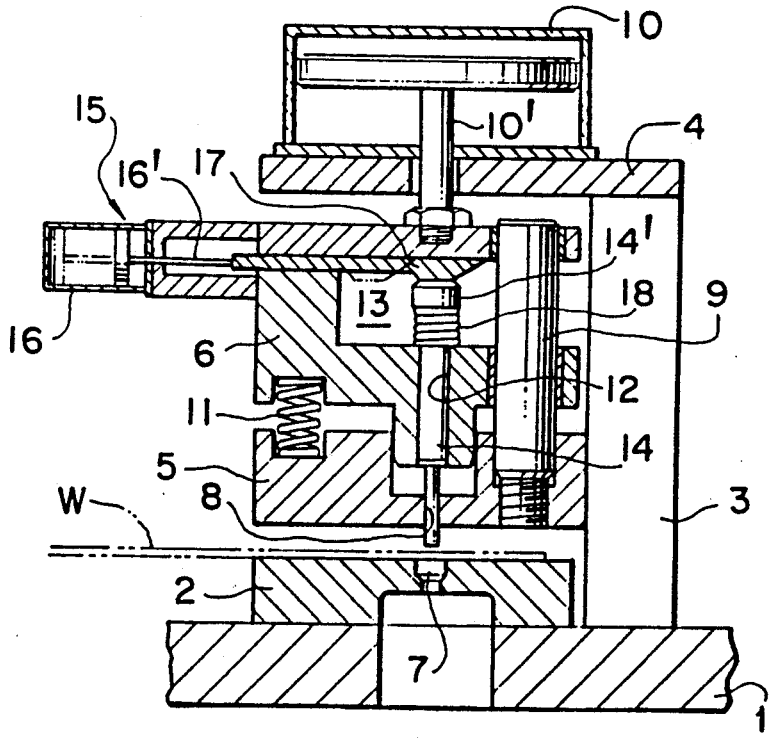
FIG. 2 is a sectional view where the punch pin is at the lower limit position.
Figure 3:
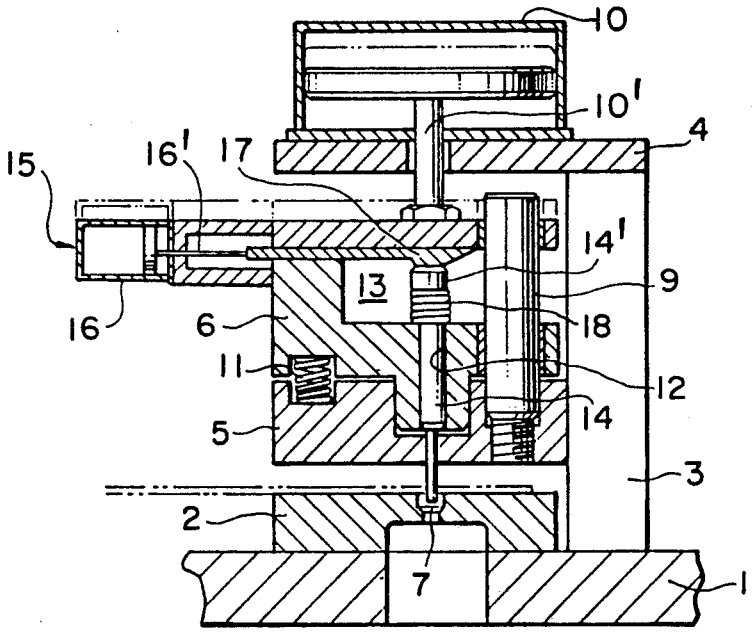
FIG. 3 is a sectional view where the punch pin has pierced a workpiece.

In FIG. 1, when rod 16' of air cylinder 16 has retracted, the punch nose of punch pin 14 is positioned at the upper limit position with the punch nose being retracted into guiding hole 8 of fixed punch holder 5. In FIG. 2, when rod 16'0 has been extended, the punch nose is positioned at the lower limit position with the punch nose projecting downwardly from guiding hole 8.

When the punch nose is positioned at the lower limit position and projects from guiding hole 8, the downward movement of movable punch holder 6 causes the punch nose to pierce a workpiece W and then pass through into slug hole 7 of die block 2.

When the punch nose is positioned at the upper limit position and is retracted into guiding hole 8, the downward movement of movable punch holder 6 prevents the punch nose from piercing a workpiece W because it does not reach the workpiece.

The operation of the air cylinders may be controlled by a computer. During a controlled operation, the upper limit position or the lower limit position of each punch nose of punch pin 14 can be selectively set to obtain any arrangement of punch pins to pierce workpiece W in accordance with any perforation pattern.

Figure 6:
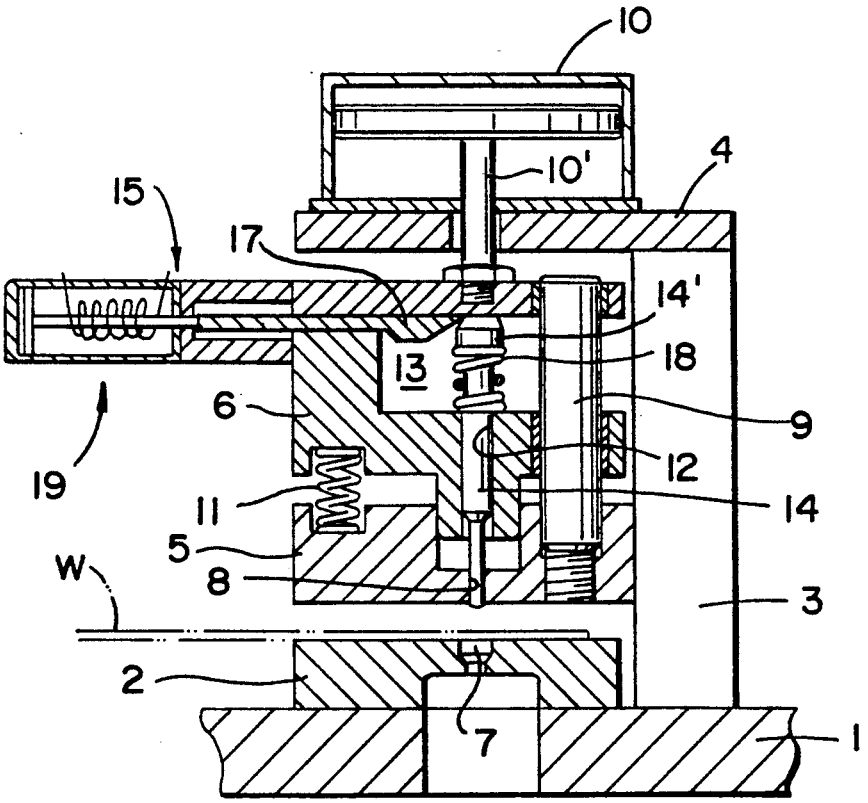
FIG. 6 is a view similar to FIG. 1, but showing an alternate embodiment of the invention.

Other arrangements within the scope of the claims may be used. For example, it is possible to substitute a solenoid 19 for air cylinder 16, as shown in FIG. 6.

Figure 5:
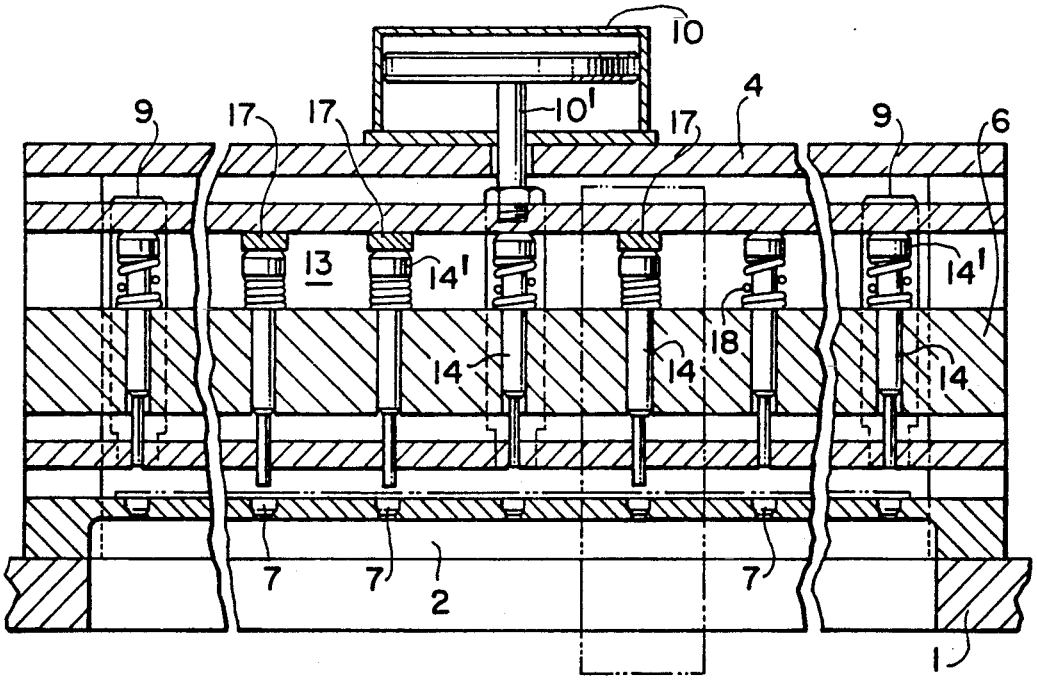
FIG. 5 is a sectional front elevation view showing separate punch pins in either the upper or lower limit positions.
Figure 4:
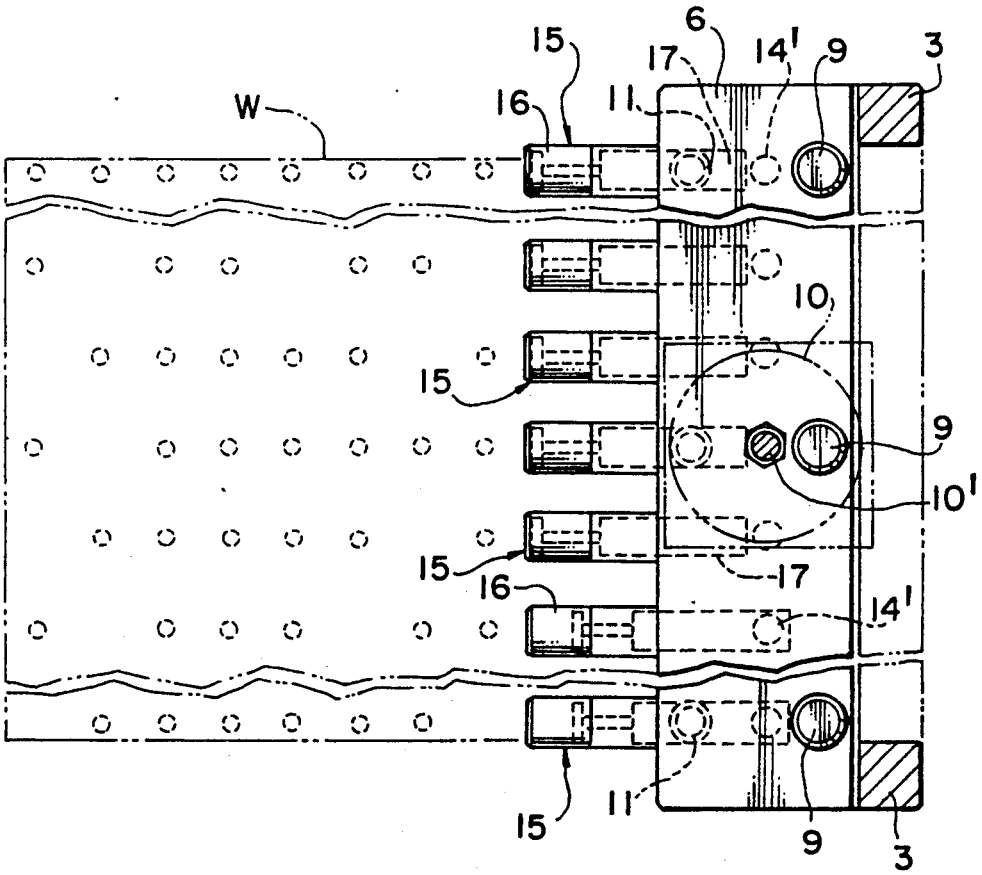
FIG. 4 is a sectional view taken along line IV-IV of FIG. 1.

In the embodiment described above, movable punch holder 6 and die block, 2 are arranged separately from each other; that is, one portion of movable punch holder 6 includes a plurality of punch pins 14, and one portion of die block 2 includes a plurality of slug holes 7. However, it is also possible to incorporate movable punch holder 6 and die block 2 into one unit so as to include only one punch pin with one slug hole such as shown in FIG. 5 by the two dot broken line. This unit is then assembled into a punch frame. This type of unit is preferable because it is possible to obtain the position of each punch and its slug hole as a unit.

According to the present invention, by providing a plurality of punch pins, for example in movable punch holder 6 and selectively using particular punch pins according to the position setting mechanism, the desired perforation pattern can easily be achieved.

Therefore, when the perforation pattern is desired to be changed during punching operation, manual operation is not required, for example, to change to another punching assembly, and it is possible to continue the punching operation by continuously feeding the workpiece even if the perforation pattern is changed for each workpiece, thereby extremely improving the productivity of the punching operation Although the invention has been described with reference to particular means, materials and embodiments, it is to be understood that the invention is not limited to the particulars disclosed and extends to all equivalents within the scope of the claims.

I claim:

1. A multiple punching press for piercing a workpiece, said multiple punching press comprising:

a) a supporting framework;

a die block mounted on said supporting framework and including a plurality of slug holes;

c) a movable punch holder mounted on said supporting framework for movement relative to said die block;

c) a plurality of punch pins held within said movable punch holder in either a first or second limit position, each punch pin being aligned with a respective slug hole; and e) a plurality of position setting mechanisms mounted on said supporting framework for selectively moving the position of any desired combination of said plurality of punch pins between said first or second limit position, whereby said desired combination of said plurality of punch pins are able to pierce said workpiece when in said first limit position and unable to pierce the workpiece when in said second limit position.

2. The multiple punching press according to claim 1, further comprising a plurality of fixing holes in said movable punch holder, each of said plurality of punch pins being held in a respective fixing hole.

3. The multiple punching press according to claim 2, further comprising a fixed punch holder mounted on said supporting framework, said fixed punch holder including a plurality of guide holes, each guide hole being aligned with a respective fixing hole.

4. The multiple punching press according to claim 2, further comprising biasing means for biasing said at least one punch pin towards its second limit position.

5. The multiple punching press according to claim 4, wherein said biasing means is a coil spring.

6. The multiple punching press according to claim 2, wherein said at least one punch pin includes a punch nose for piercing the workpiece and an upper portion projecting from said fixing hole, said position setting mechanism engaging said upper portion to move said at least one punch pin to its first limit position.

7. The multiple punching press according to claim 6, wherein said position setting mechanism includes a cam for engaging said upper portion of said at least one punch pin.

8. The multiple punching press according to claim 7, wherein said position setting mechanism includes an actuator, said cam being connected to said actuator.

9. The multiple punching press according to claim 8, wherein said actuator is a fluid cylinder.

10. The multiple punching press according to claim 8, wherein said actuator is a solenoid.

11. The multiple punching press according to claim 8, wherein said movable punch holder includes a space, said upper portion of said at least one punch pin projecting into said space, and said cam engaging said upper portion within said space.

12. The multiple punching press according to claim 11, wherein said actuator and said at least one punch pin are arranged substantially perpendicular to each other.

13. The multiple punching press according to claim 3, and further including means to absorb shock between said movable punch holder and said fixed punch holder.

14. The multiple punching press according to claim 13 wherein said means to absorb shock is at least one spring.

15. The multiple punching press according to claim 1, including a plurality of position setting mechanisms for respective punch pins.

16. The multiple punching press according to claim 15, wherein each position setting mechanism includes an actuator.

17. The multiple punching press according to claim 16, wherein each actuator is selectively controlled by a computer.

18. The multiple punching press according to claim 1, wherein said movable punch holder and said die block are constructed as a unit.

19. The multiple punching press according to claim 19, wherein said unit includes only one punch pin and only one slug hole, a plurality of said units being assembled onto said supporting framework.

20. A method of piercing a workpiece comprising:

providing a movable punch holder with a plurality of punch pins;

selectively moving any desired combination of more than one of said plurality of said punch pins between a first limit position and a second limit position within said movable punch holder; and moving said movable punch holder to pierce the workpiece, whereby said desired combination of said plurality of punch pins are able to pierce said workpiece when in said first limit position and are unable to pierce said workpiece when in said second limit position.

21. The method of piercing a workpiece according to claim 20, comprising selectively moving a plurality of punch pins between said first limit position and said second limit position.

22. The method of piercing a workpiece according to claim 20, comprising engaging said at least one punch pin with a cam to move said punch pin to said first limit position.

23. The method of piercing a workpiece according to claim 20, comprising biasing said at least one punch pin to said second limit position

24. The method of piercing a workpiece according to claim 20 comprising forming said movable punch holder and a die block as a unit, and assembling a plurality of said units to form an assembly of a plurality of punch pins.

25. The method of piercing a workpiece according to claim 20, further comprising absorbing shock caused by movement of said movable punch holder.

* * * * *